US011156347B2

(12) United States Patent
Luo et al.

(10) Patent No.: US 11,156,347 B2
(45) **Date of Patent: *Oct. 26, 2021**

(54) PANEL LIGHT APPARATUS WITH FOLDING HOOKS

(71) Applicant: XIAMEN LEEDARSON LIGHTING CO. LTD., Fujian (CN)

(72) Inventors: Tong Luo, Fujian (CN); Lei Zhang, Fujian (CN); Zhiyon Jiang, Fujian (CN)

(73) Assignee: XIAMEN LEEDARSON LIGHTING CO. LTD., Xiamen (CN)

( * ) Notice: Subject to any disclaimer, the term of this patent is extended or adjusted under 35 U.S.C. 154(b) by 0 days.

This patent is subject to a terminal disclaimer.

(21) Appl. No.: 16/904,569

(22) Filed: Jun. 18, 2020

(65) Prior Publication Data

US 2021/0131654 A1 May 6, 2021

(30) Foreign Application Priority Data

Oct. 30, 2019 (CN) ..... 2019218490777.0

(51) Int. Cl.
*F21V 23/00* (2015.01)
*F21V 3/02* (2006.01)
(Continued)

(52) U.S. Cl.
CPC ..... *F21V 23/009* (2013.01); *F21S 4/20* (2016.01); *F21S 4/28* (2016.01); *F21V 3/02* (2013.01); *F21V 5/007* (2013.01); *F21V 5/043* (2013.01); *F21V 7/06* (2013.01); *F21V 7/08* (2013.01); *F21V 7/09* (2013.01); *F21V 21/0832* (2013.01); *F21V 23/001* (2013.01); *F21V 23/008* (2013.01); *F21V 23/06* (2013.01);
(Continued)

(58) Field of Classification Search
CPC ..... H05B 45/50; H05B 45/52; H05B 47/20; H05B 47/21; F21V 19/003; F21V 19/0035; F21V 19/0045; F21V 23/001; F21V 23/008; F21Y 2107/70; F21Y 2113/20
See application file for complete search history.

(56) References Cited

U.S. PATENT DOCUMENTS

2007/0247842 A1* 10/2007 Zampini ..... F21V 23/04 362/227
2012/0320627 A1* 12/2012 Araki ..... F21S 8/04 362/608

(Continued)

*Primary Examiner* — Keith G. Delahoussaye
(74) *Attorney, Agent, or Firm* — Chun-Ming Shih; Lanway IPR Services

(57) ABSTRACT

The back plate has four lateral walls and a bottom plate. A back side of the bottom plate includes multiple sets of folding hooks. Each set corresponds a different installation platform. One of the multiple sets of folding hooks is folded to be used for hooking to a corresponding installation platform. The light source module has multiple LED modules disposed on the bottom plate. Each LED module has a LED device and a lens. The lens diffuses a light of the LED device to be evenly emitted from the lens and broadening an output angle of the light via the lens. The diffusion plate with a peripheral edge is fixed to the four lateral walls of the back plate. The driver cover is attached to an external side of one of the four walls of the back plate. The driver cover defines a container cavity for concealing the driver module.

19 Claims, 11 Drawing Sheets

(51) Int. Cl.

| | |
|---|---|
| ***F21V 23/06*** | (2006.01) |
| ***F21V 5/00*** | (2018.01) |
| ***F21V 7/09*** | (2006.01) |
| ***F21S 4/20*** | (2016.01) |
| ***H05B 47/21*** | (2020.01) |
| ***F21S 4/28*** | (2016.01) |
| ***F21V 7/06*** | (2006.01) |
| ***H05B 45/50*** | (2020.01) |
| ***H05B 45/52*** | (2020.01) |
| ***F21V 7/08*** | (2006.01) |
| ***F21V 21/08*** | (2006.01) |
| ***H05B 47/20*** | (2020.01) |
| ***F21V 5/04*** | (2006.01) |
| *F21Y 105/16* | (2016.01) |
| *F21Y 115/10* | (2016.01) |
| *F21Y 113/20* | (2016.01) |
| *F21Y 107/70* | (2016.01) |

(52) U.S. Cl.
CPC ..... *H05B 45/50* (2020.01); *H05B 45/52* (2020.01); *H05B 47/20* (2020.01); *H05B 47/21* (2020.01); *F21Y 2105/16* (2016.08); *F21Y 2107/70* (2016.08); *F21Y 2113/20* (2016.08); *F21Y 2115/10* (2016.08)

(56) References Cited

U.S. PATENT DOCUMENTS

2013/0107530 A1* 5/2013 Wyrick ..... F21V 5/002 362/249.02
2013/0128582 A1* 5/2013 Holec ..... H05K 1/189 362/249.02
2014/0313780 A1* 10/2014 Myers ..... F21V 23/006 362/646
2015/0036387 A1* 2/2015 Myers ..... F21V 15/01 362/646
2018/0209621 A1* 7/2018 Sperling ..... F21V 9/38

* cited by examiner

PANEL LIGHT APPARATUS WITH FOLDING HOOKS

FIELD

The present application is related to a panel light apparatus and more particularly related to a LED panel light apparatus.

BACKGROUND

The time when the darkness is being lighten up by the light, human have noticed the need of lighting up this planet. Light has become one of the necessities we live with through the day and the night. During the darkness after sunset, there is no natural light, and human have been finding ways to light up the darkness with artificial light. From a torch, candles to the light we have nowadays, the use of light have been changed through decades and the development of lighting continues on.

Early human found the control of fire which is a turning point of the human history. Fire provides light to bright up the darkness that have allowed human activities to continue into the darker and colder hour of the hour after sunset. Fire gives human beings the first form of light and heat to cook food, make tools, have heat to live through cold winter and lighting to see in the dark.

Lighting is now not to be limited just for providing the light we need, but it is also for setting up the mood and atmosphere being created for an area. Proper lighting for an area needs a good combination of daylight conditions and artificial lights. There are many ways to improve lighting in a better cost and energy saving. LED lighting, a solid-state lamp that uses light-emitting diodes as the source of light, is a solution when it comes to energy-efficient lighting. LED lighting provides lower cost, energy saving and longer life span.

The major use of the light emitting diodes is for illumination. The light emitting diodes is recently used in light bulb, light strip or light tube for a longer lifetime and a lower energy consumption of the light. The light emitting diodes shows a new type of illumination which brings more convenience to our lives. Nowadays, light emitting diode light may be often seen in the market with various forms and affordable prices.

After the invention of LEDs, the neon indicator and incandescent lamps are gradually replaced. However, the cost of initial commercial LEDs was extremely high, making them rare to be applied for practical use. Also, LEDs only illuminated red light at early stage. The brightness of the light only could be used as indicator for it was too dark to illuminate an area. Unlike modern LEDs which are bound in transparent plastic cases, LEDs in early stage were packed in metal cases.

In 1878, Thomas Edison tried to make a usable light bulb after experimenting different materials. In November 1879, Edison filed a patent for an electric lamp with a carbon filament and keep testing to find the perfect filament for his light bulb. The highest melting point of any chemical element, tungsten, was known by Edison to be an excellent material for light bulb filaments, but the machinery needed to produce super-fine tungsten wire was not available in the late 19th century. Tungsten is still the primary material used in incandescent bulb filaments today.

Early candles were made in China in about 200 BC from whale fat and rice paper wick. They were made from other materials through time, like tallow, spermaceti, colza oil and beeswax until the discovery of paraffin wax which made production of candles cheap and affordable to everyone. Wick was also improved over time that made from paper, cotton, hemp and flax with different times and ways of burning. Although not a major light source now, candles are still here as decorative items and a light source in emergency situations. They are used for celebrations such as birthdays, religious rituals, for making atmosphere and as a decor.

Illumination has been improved throughout the times. Even now, the lighting device we used today are still being improved. From the illumination of the sun to the time when human can control fire for providing illumination which changed human history, we have been improving the lighting source for a better efficiency and sense. From the invention of candle, gas lamp, electric carbon arc lamp, kerosene lamp, light bulb, fluorescent lamp to LED lamp, the improvement of illumination shows the necessity of light in human lives.

Panel light devices are widely used in various environments. The thickness of panel light devices is attractive. Therefore, it is a great challenge to design a flexible panel light device with great functions.

SUMMARY

In some embodiments, a panel light apparatus including a back plate, a light source module, a diffusion plate, a driver module and a driver cover.

The back plate has four lateral walls and a bottom plate. A back side of the bottom plate includes multiple sets of folding hooks. Each set corresponds a different installation platform. One of the multiple sets of folding hooks is folded to be used for hooking to a corresponding installation platform.

The light source module has multiple LED modules disposed on the bottom plate. Each LED module has a LED device and a lens. The lens diffuses a light of the LED device to be evenly emitted from the lens and broadening an output angle of the light via the lens.

The diffusion plate with a peripheral edge is fixed to the four lateral walls of the back plate. The driver cover is attached to an external side of one of the four walls of the back plate. The driver cover defines a container cavity for concealing the driver module.

In some embodiments, the receiver socket further has a limiter for increasing friction between the receiver socket and the wire plug.

In some embodiments, the limiter is a hole with a smaller diameter than a main hole for receiving a main part of the wire plug.

In some embodiments, the driver cover is made of metal material.

In some embodiments, the driver cover and an exterior surface of one lateral wall of the back plate together form the container cavity for concealing the driver module.

In some embodiments, the driver cover has multiple sections. A first section of the multiple sections is used for containing the driver module. A second section of the multiple sections is used for connecting a first wire. There is a separator between the first section and the second section.

In some embodiments, a third section of the multiple sections is used for connecting a second wire. A voltage passing the first wire is larger than a voltage passing the second wire.

In some embodiments, the multiple sets of folding hooks are fit to a surface of the back plate.

In some embodiments, one of the multiple sets of folding hooks are located at four corners of the back plate.

In some embodiments, a connection edge between the four lateral walls and the bottom plate has a curved reflective area for reflecting the light of the LED modules toward the diffusion plate.

In some embodiments, the bottom plate has a metal layer and reflective layer. The reflective layer of the bottom plate help reflecting a light of the multiple LED modules emitting on the reflective layer of the bottom plate.

In some embodiments, the bottom plate has multiple curved reflective areas respectively facing toward the multiple LED modules for reflecting the light of the multiple LED modules toward the diffusion plate.

In some embodiments, the LED module has multiple LED devices integrated on a package. The multiple LED devices on the package are positioned to have different angles for emitting multiple lights from the package.

In some embodiments, the multiple lights of the multiple LED devices for different angles have different light intensities.

In some embodiments, the light intensities are adjusted by the driver module to provide an overall even output on the diffusion layer.

In some embodiments, an external device captures an output light pattern appeared on the diffusion plate and sends a message related to the captured output light pattern to the driver module to adjust the intensities of the multiple LED devices in the package.

In some embodiments, the driver module has a first driver part and a second driver part. When one of the first driver part and the second driver part is damaged, the other of the first driver part and the second driver part is activated.

In some embodiments, the LED modules are divided into groups to be controlled by the driver module separately to produce different light areas as requested by a user.

In some embodiments, the groups correspond to luminance areas of different dimensions.

In some embodiments, the multiple LED modules are divided and placed on multiple LED strips disposed in parallel. A conductive path is placed away from peripheral edge of the bottom plate with a distance from the peripheral edge of more than 10% of a width of the bottom plate. The conductive path is used for electrically connecting the multiple LED strips to the driver module.

DETAILED DESCRIPTION

Figure 11:
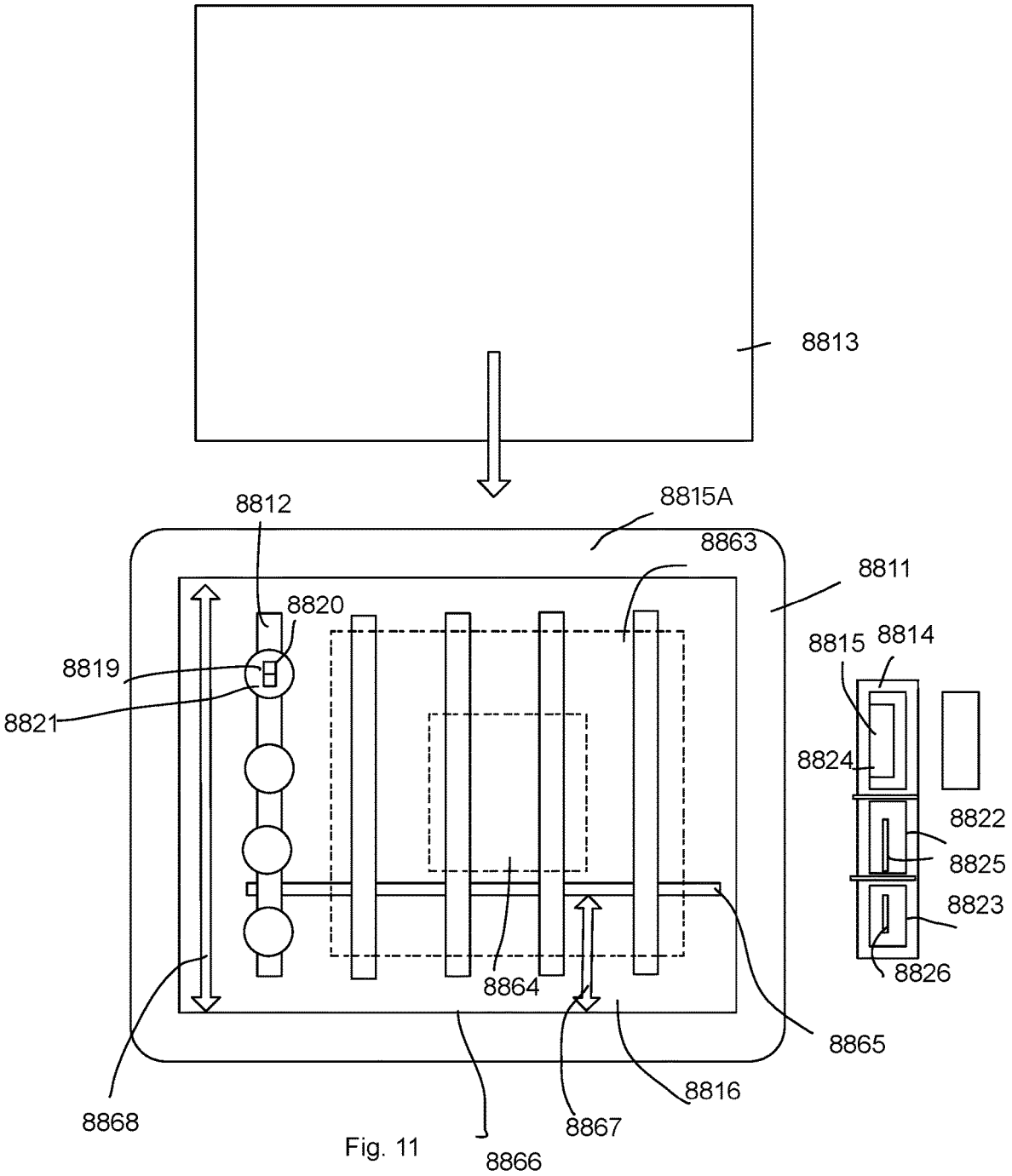
FIG. 11 shows an structure diagram of a panel light apparatus.

In FIG. 11, a panel light apparatus including a back plate 8811, a light source module 200, a diffusion plate 8813, a driver module 8815 and a driver cover 8814. The back plate 8811 has four lateral walls 8815A and a bottom plate 8816.

Figure 12:
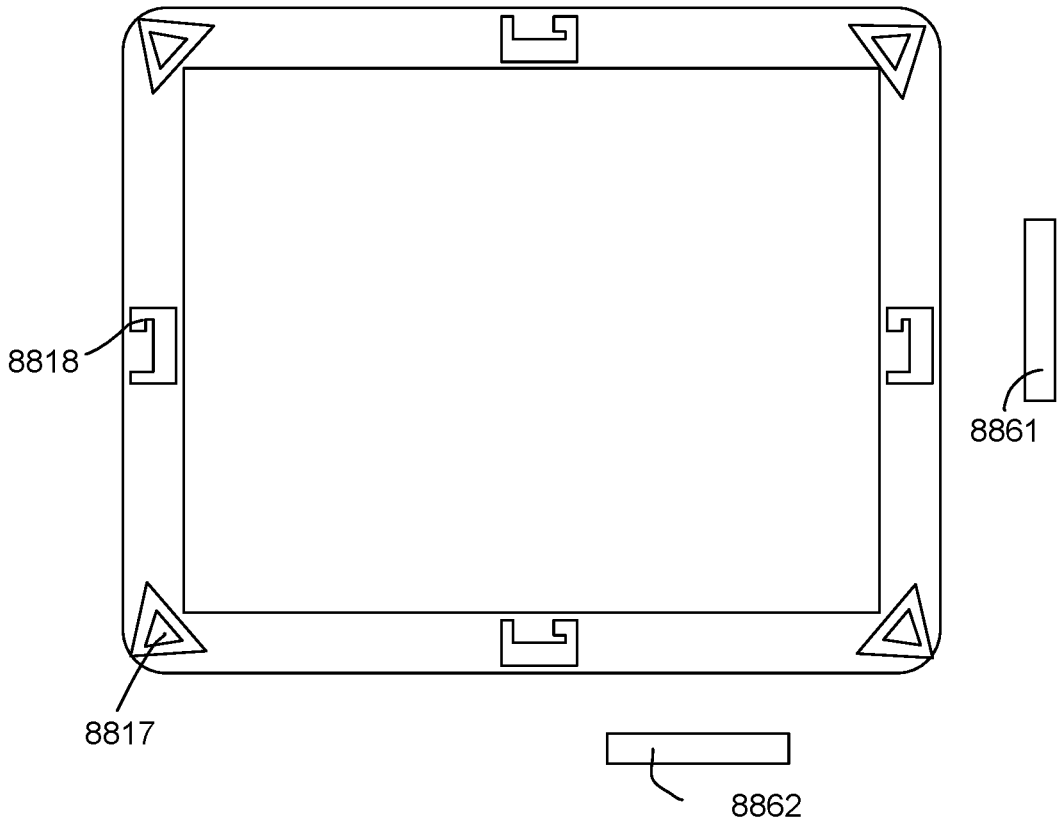
FIG. 12 shows a back view of an example with multiple sets of folding hooks.

In FIG. 12, A back side of the bottom plate includes multiple sets of folding hooks 8817 and 8818. In FIG. 12, the first set of hooks include triangle folding hooks 8817 on four corners. The second set of hooks include four L-shape hooks 8818 that may be folded to extend from surface of the back plate.

Each set corresponds a different installation platform. One of the multiple sets of folding hooks is folded to be used for hooking to a corresponding installation platform.

In FIG. 11, a light source module 200 has multiple LED modules 8819 disposed on the bottom plate 8816. Each LED module 8819 has a LED device 8820 and a lens 8821. The lens 8821 diffuses a light of the LED device 8820 to be evenly emitted from the lens 8821 and broadening an output angle of the light via the lens 8821.

The diffusion plate 8813 with a peripheral edge is fixed to the four lateral walls 8815A of the back plate 8811. The driver cover 8814 is attached to an external side of one of the four walls 8815 of the back plate 8811. The driver cover 8814 defines a container cavity 8816 for concealing the driver module 8815.

In some embodiments, the driver cover 8814 is made of metal material.

In some embodiments, the driver cover 8814 and an exterior surface of one lateral wall 8815 of the back plate together form the container cavity for concealing the driver module 8815.

In some embodiments, the driver cover 8814 has multiple sections 8824, 8822, 8823. A first section 8824 of the multiple sections is used for containing the driver module 8815. A second section 8822 of the multiple sections is used for connecting a first wire 8825. There is a separator 8827 between the first section 8824 and the second section 8822.

In some embodiments, a third section 8823 of the multiple sections is used for connecting a second wire 8826. A voltage passing the first wire 8825 is larger than a voltage passing the second wire 8826. For example, the first wire 8825 is connected to a 110V or 220V alternating power source. The second wire 8826 is connected to a dimmer switch on a wall with lower voltage.

In some embodiments, the multiple sets of folding hooks are fit to a surface of the back plate.

In FIG. 12, one set of folding hook 8817 of the multiple sets of folding hooks are located at four corners of the back plate.

Figure 13:
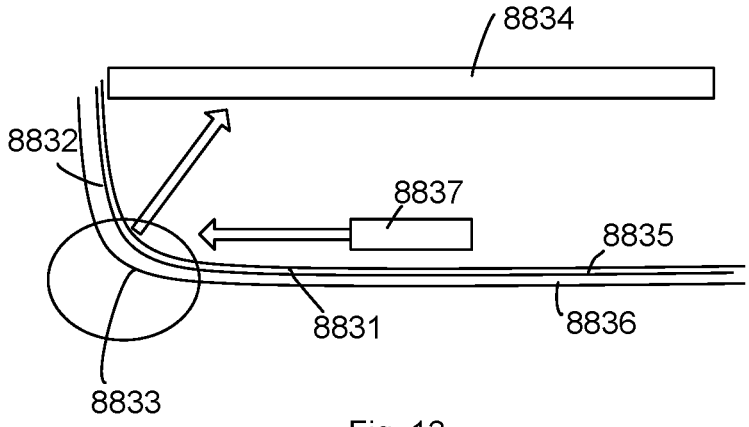
FIG. 13 shows a corner structure of a back plate.

In FIG. 13, a connection edge 8833 between the four lateral walls 8832 and the bottom plate 8831 has a curved reflective area for reflecting the light of the LED modules toward the diffusion plate 8834.

In FIG. 13, the bottom plate has a metal layer 8836 and reflective layer 8835. The reflective layer 8836 of the bottom plate help reflecting a light of the multiple LED modules 8837 emitting on the reflective layer 8835 of the bottom plate.

In some embodiments, the bottom plate has multiple curved reflective areas 8833 respectively facing toward the multiple LED modules 8837 for reflecting the light of the multiple LED modules toward the diffusion plate 8835.

Figure 14:
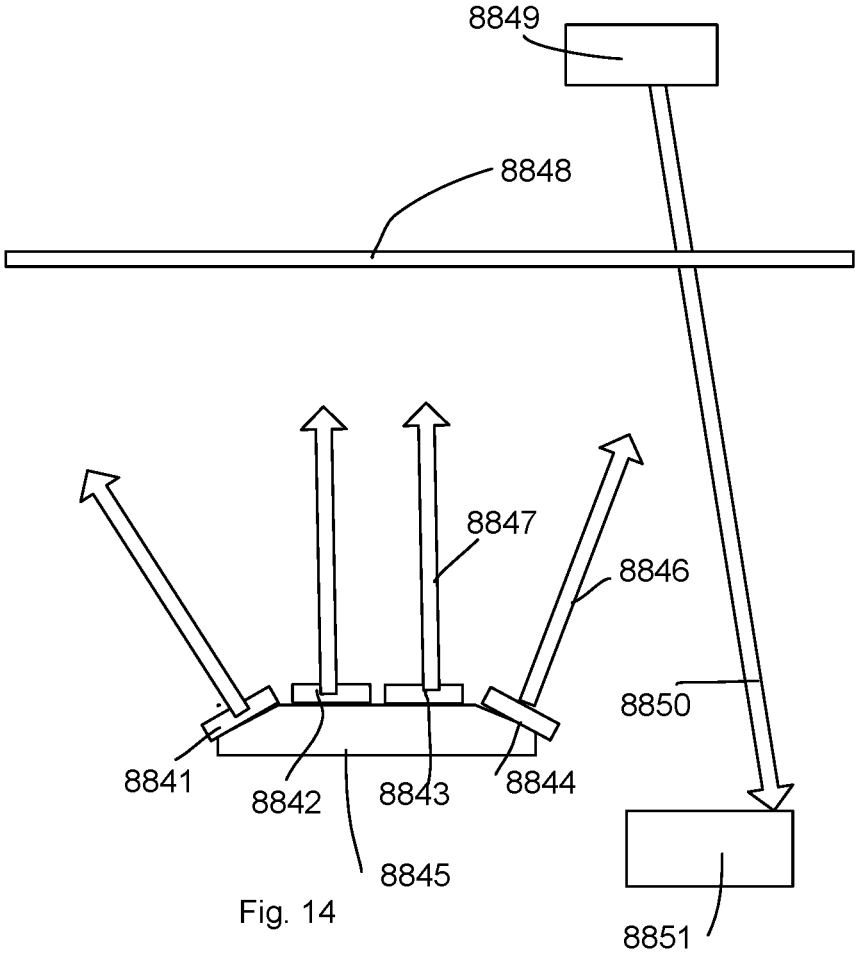
FIG. 14 shows a package with multiple LED devices.

In FIG. 14, the LED module has multiple LED devices 8841, 8842, 8843, 8844 integrated on a package 8845. The multiple LED devices 8841, 8842, 8843, 8844 on the package 8845 are positioned to have different angles for emitting multiple lights from the package 8845. The lens mentioned may still be used for diffusing lights from the LED devices 8841, 8842, 8843, 8844. In some embodiments, if the LED devices are positioned properly, the lens may even be reduced to further saving cost and decrease light waste on passing lens while an evenly distributed light pattern is still obtained.

In some embodiments, the multiple lights 8846, 8847 of the multiple LED devices 8844, 8843 for different angles have different light intensities.

In some embodiments, the light intensities are adjusted by the driver module to provide an overall even output on the diffusion layer 8848. The lights from the LED modules are summed and appear a light pattern on the diffusion layer 8848. By adjusting proper intensities of the LED devices 8844, 8843 for different angles, an even output on the diffusion layer 8848 may be obtained. The effect would be better if lens are used. But, if the LED devices and angles on placing the LED devices are well configured, the lens may be reduced.

In FIG. 14, an external device 8849 captures an output light pattern appeared on the diffusion plate 8848 and sends a message 8850 related to the captured output light pattern to the driver module 8851 to adjust the intensities of the multiple LED devices 8841, 8842, 8843, 8844 in the package 8845. There are multiple packages 8845 for the LED modules and the overall light effect may be carefully configured by the external device 8849. Such adjustment may be performed in a factory and the parameters of the driver module is stored for each type of panel light apparatus. Such configuration may be adjusted by users, e.g. using a phone to capture a light pattern image appearing on the diffusion plate 8848. The image is analyzed by an app of the phone and then the message is transmitted to the driver module 8851 to configure the intensities of LED devices on different tilt angles.

In FIG. 12, the driver module has a first driver part 8861 and a second driver part 8862. When one of the first driver part 8861 and the second driver part 8862 is damaged, the other of the first driver part 8861 and the second driver part 8862 is activated. Compared with the LED modules, the driver module is more complicated and may be damaged more easily. By providing a backup driver component, the overall life span of the panel light apparatus is increased. The switch may be automatic or manually by user, e.g. operating a manual switch.

With two driver parts, the two driver parts may be activated automatically to further increase life span of the driver module. For example, a timer is set for switching use of the two driver parts alternatively. Such design prevents any of the driver part staying in high working temperatures that may cause damages of the driver module.

In FIG. 11, the LED modules are divided into groups to be controlled by the driver module separately to produce different light areas 8863, 8864 as requested by a user. Specifically, different light areas 8863, 8864 may be turned on with different luminance are sizes. People may need soft or small light when they are preparing to get sleep. In such time, they may use a small light area with smaller light intensity instead of decreasing overall intensity of all LED modules. In some other cases, larger light area may be needed.

In some embodiments, the groups correspond to luminance areas of different dimensions.

In FIG. 11, the multiple LED modules are divided and placed on multiple LED strips disposed in parallel as the five light strips in FIG. 11. A conductive path 8865 is placed away from peripheral edge of the bottom plate with a distance 8867 from the peripheral edge 8866 of more than 10% of a width 8868 of the bottom plate. The conductive path 8865 is used for electrically connecting the multiple LED strips to the driver module.

Figure 1:
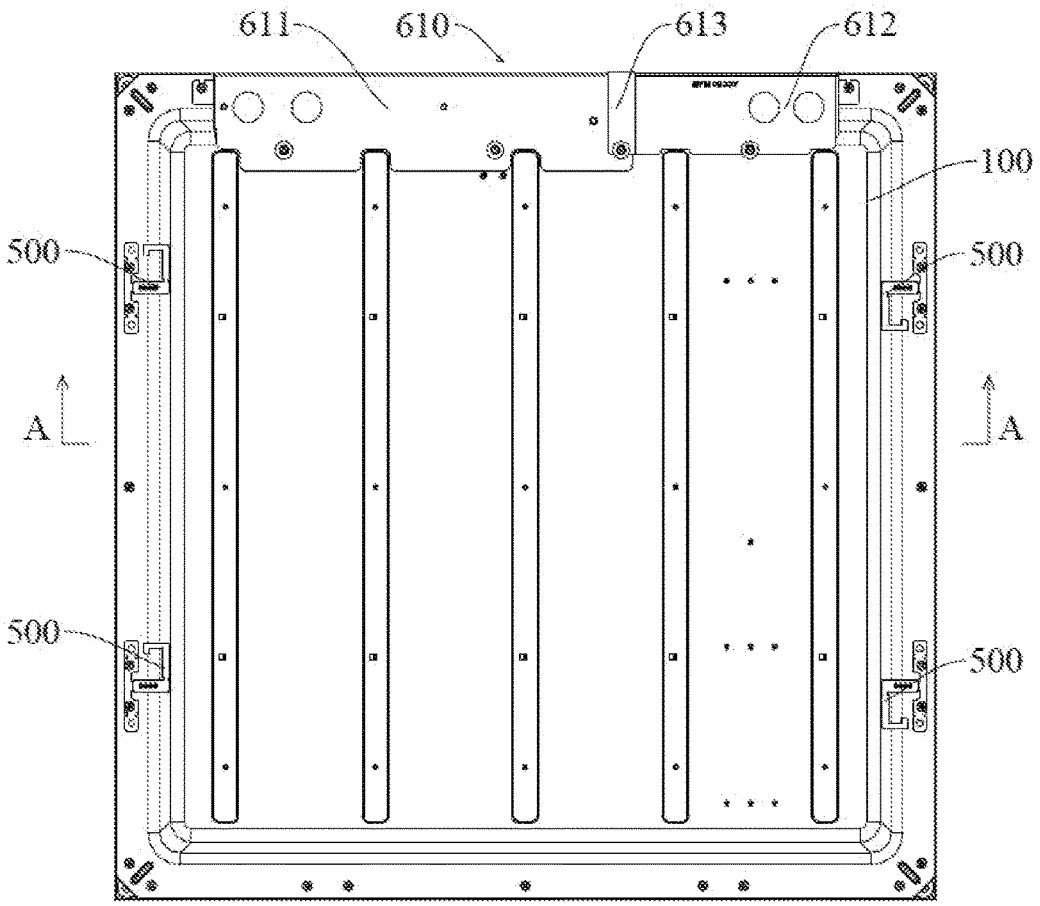
FIG. 1 illustrates an embodiment of a panel light apparatus.
Figure 2:
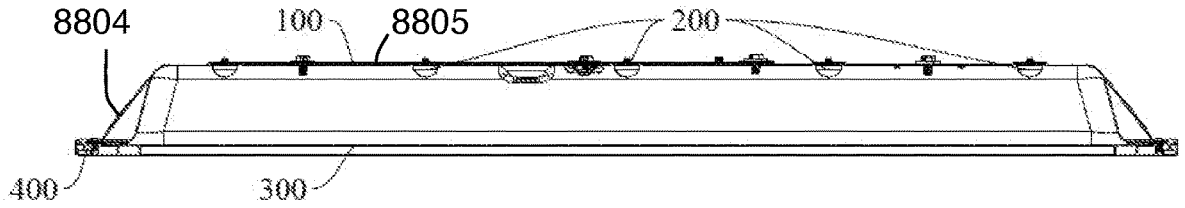
FIG. 2 illustrates a side view of the example in FIG. 1.

Please refer to FIG. 1 and FIG. 2. A panel light apparatus includes a back plate 100. The back plate 100 has a bottom plate 8804 and four lateral walls 8805 extending from and surrounding the back plate 100. The panel light also has a light source module 200 disposed on the bottom plate. The four walls of the base plate are connected to a diffusion plate 300. On the back side of the back plate 100, there are hooks 500 and a driver kit 600.

The diffusion plate 300 is connected to the back plate 100 with fasteners 400. The hooks 500 are used for connecting to an installation platform on a wall or on a ceiling.

The driver kit 600 includes a driver module for converting an external power to a driving current supplied to the light source module 200. The light source module 200 includes multiple LED modules. Each LED module has a LED device and a lens covering the LED device for diffusing a light of the LED module to the diffusion plate 300.

The driver kit 600 includes a driver cover 610 and a driver module 620 stored in a container cavity defined by the driver 610. Specifically, the driver cover 610 is attached to an external side of one of the four lateral walls of the back plate. The driver cover 610 may form a container cavity for storing the driver module 620. In some other embodiments, the driver cover 610 and a portion of the lateral wall of the back cover together form the container cavity.

The driver cover 610 includes a cover housing 611 and a movable driver concealing plate 612. The driver module 620 is disposed on the cover housing 611. The cover housing 611 has a driver opening for exposing the driver module 620. The driver concealing plate 612 is manually detachable from the driver cover 610. When the driver concealing plate 612 is moved, the driver module 620 is exposed so that users may operate on the driver module 620, e.g. to operate a manual switch of the driver module 620. When the driver concealing plate 612 is placed to cover the driver opening, the driver module 620 is concealed by the driver cover 610 and the driver concealing plate 612 to protect the driver module 620 and prevent people getting electric shock.

During installation, the driver module 620 is placed on the cover housing 611 and then the driver housing 611 is buckled to the back plate 100 of the panel light apparatus. The cover housing 611 and the back plate 100 together form a container cavity for storing the driver module 620. The driver concealing plate 612 is installed to conceal the container cavity.

The panel light apparatus is attached to a wall or a ceiling by using the hooks of the panel light apparatus 500 to a screw or other fixing devices. In some embodiments, there are multiple sets of hooks. Each set of hook corresponds to a type of installation platform. For different installation platform, a corresponding hook is selected and folded. Other hooks not selected may be kept flattened and unfolded.

In some embodiments, the driver cover may include module slots for plugging function modules required by the users. For example, a wireless function module may be plugged to the driver cover to add communication function of the panel light apparatus. Specifically, the wireless function module is connected to the driver module to expand the power of the driver module. Other function module examples include speakers, sensors, fire alarm modules, smoke detection modules, and any function modules that expand functions of the panel light apparatus or just receive power supply from the driver module. For example, a Wi-Fi hot spot may be installed for receiving the power supply of the driver module, while not necessary to co-work directly with any other component of the panel light apparatus.

In some embodiments, the driver module is a box with a manual switch on its surface.

There may be one or multiple openings on the driver cover, in addition to the driver opening. For example, the cover housing 611 or the driver concealing plate 612 may have wiring holes for passing a wire so as to connect an external wire to the driver module 620 stored in the driver cover.

Figure 3:
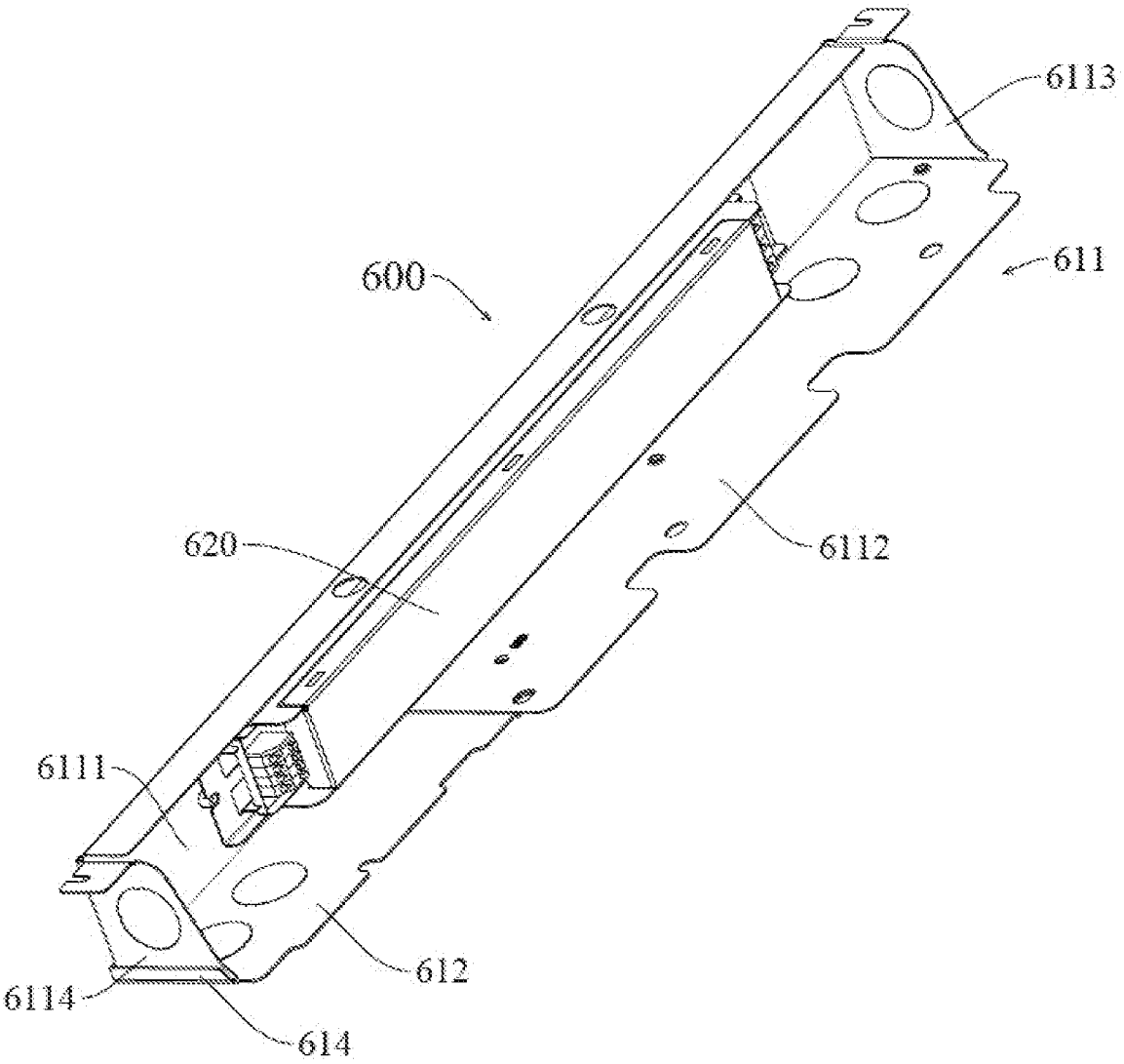
FIG. 3 illustrates a driver kit example.
Figure 4:
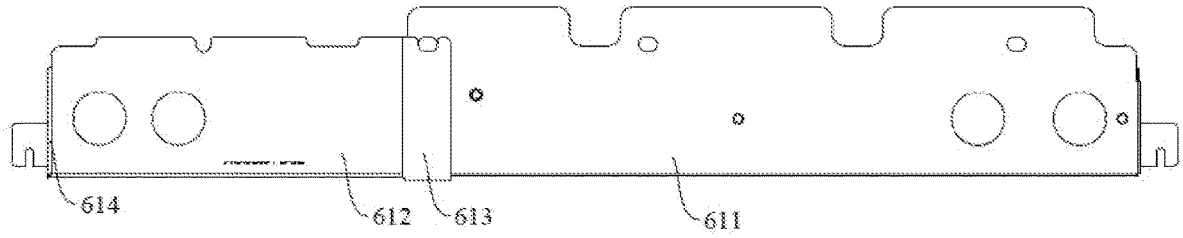
FIG. 4 illustrates a top view of a driver cover.
Figure 5:
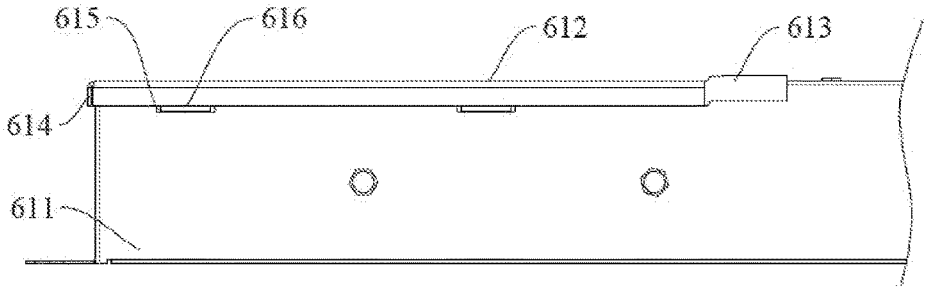
FIG. 5 illustrates another view of the example in FIG. 4.

Please refer to FIG. 3 to FIG. 5. The cover housing 611 includes a support plate 6111 and a top plate 6112 perpendicular to the support plate 6111, and a lateral plate 6113 connecting to the top plate 6112.

The second lateral plate 6114 and the top plate 6112 form an opening. The top plate 6112, the first lateral plate 6113 and the second lateral plate 6114 are disposed at the same side of the support plate 6111 and connected to the support plate 6111.

The top plate 6112 and the second lateral plate 6114 are disposed with a gap forming an opening. Such design reduces a hole stamping operation and increases production efficiency.

The driver 620 is installed on an inner surface of the support plate 6111 to be placed inside a U-shape container cavity. Specifically, the driver concealing plate 612, the top plate 6112, the first lateral plate 6113 and the second lateral plate 6114 together form an U-shape container cavity for storing the driver module 620.

Please refer to FIG. 3 to FIG. 5. The driver concealing plate 612 has a connecting part 613 on the side close to the top plate 6112 for connecting to the top plate 6112. There is a shielding part 614 on the end for shielding plate 612 and the second lateral plate 6114.

The first connecting part 613 implements a connection between the driver concealing plate 612 and the top plate 6112 so that operators may use a screw bolt to connect the first connecting part 613 and the top plate 6112.

The first connecting part 613 shields the gap between the driver concealing plate 612 and the top plate 6112 to prevent dust entering the container cavity to increase the life span of the driver module 620.

In FIG. 3, in some embodiments, the support plate 6111, the top plate 6112, the first lateral plate 6113 and the second lateral plate 6114 are made as a one-piece structure.

In FIG. 4, the first connecting part 613 is connected to the top plate 6112 with a screw bolt. The connecting part 613

Please refer FIG. 5. There is a support plate 6111 connecting to the driver concealing plate 612. There is a first plugging part 615, corresponding to a second plugging part 616.

The first plugging part 615 may be a plugging hole or a plugging groove. The second plugging part 616 may be a corresponding plugging groove or a plugging plate.

Please refer to FIG. 3. The support plate 6111 has a third connecting part detachable connected to the back plate 100. The first lateral plate 6113 and the second lateral plate 6114 respectively have a fourth connecting part for detachably connecting to the back plate 100.

The driver concealing plate 612 has a second connecting part for detachably connecting to the back plate 100. A screw bolt is used for connecting the support plate 6111, the top plate 6112, the first lateral plate 6113, the second lateral plate 6114 and the driver concealing plate 612 to the back plate 100 to fix different portions of the driver cover 610 to the back plate 100.

The third connecting part is integrated as a one-piece structure with the support plate 6111. The first lateral plate 6113 and the second lateral plate 6114 are made as a one-piece structure with the fourth connecting part. The driver concealing plate 612 and the second connecting part are made as a one-piece structure.

Please refer to FIG. 6 to FIG. 10. The driver module 620 includes a housing 21, a circuit board 622 stored in the housing and a wire terminal 623.

The circuit board 622 has two ends extending outside the container cavity formed by the housing 621. The wire terminal 623 is placed outside the container cavity and plugged to fix to the circuit board 622.

The wire terminal 623 includes an insulation body 6231. There is a second plugging hole 6232, as a receiver socket, on the insulation body 6231 for connecting to a wire plug. There is an electrode 6233 electrically connected to a driver wire connected to the circuit board 622. The receiver socket has a tilt angle between 10 degrees to 80 degrees with respect to the driver circuit board 622. There is an acute angle between an axial line of the second plugging hole 6232 and a bottom side of the insulation body 6231.

There is a limiter 8801, which may be an additional hole connecting to the second plugging hole to increase friction between the wire plug and the second plugging hole 6232.

When an external wire is connected to the circuit board 622, the wire plug of the external wire is plugged into the second plugging hole 6232 to electrically contact with the electrode 6233.

Figure 10:
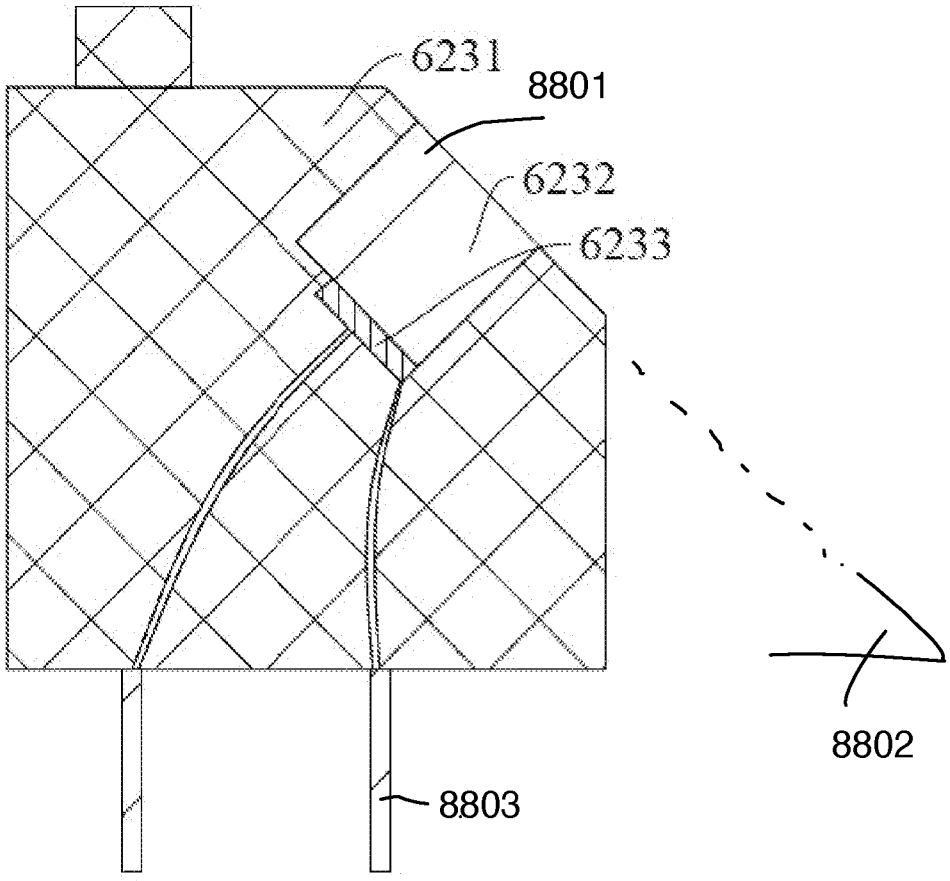
FIG. 10 illustrates a cross-sectional view of a wire terminal component.

Unlike normal plugging hole 6232, which is set horizontally, there is a tilt angle for disposing the second plugging hole 6232 to keep the driver wire and the wire plug not in the same line, but with an angle between 10 degrees to 80 degrees. In FIG. 10, the angle 8802 shows the tilt surface of the receiver socket and the circuit board of the driver module. It would be the same when the angle is taken for considering the axial line of the receiver socket and the circuit board, both with an acute tilt angle with respect to driver wire 8803 of the driver module.

Such design prevents an undesired disconnection or damage when the wire plug is removed from the second plugging hole 6232.

The housing 621 protects the circuit board 622, decreases dust collecting on the circuit board 622 that may cause certain risk. The wire terminal 623 is placed in the container cavity of the housing 621 for the wire plug easily connecting or disconnecting from the wire terminal 623.

Figure 7:
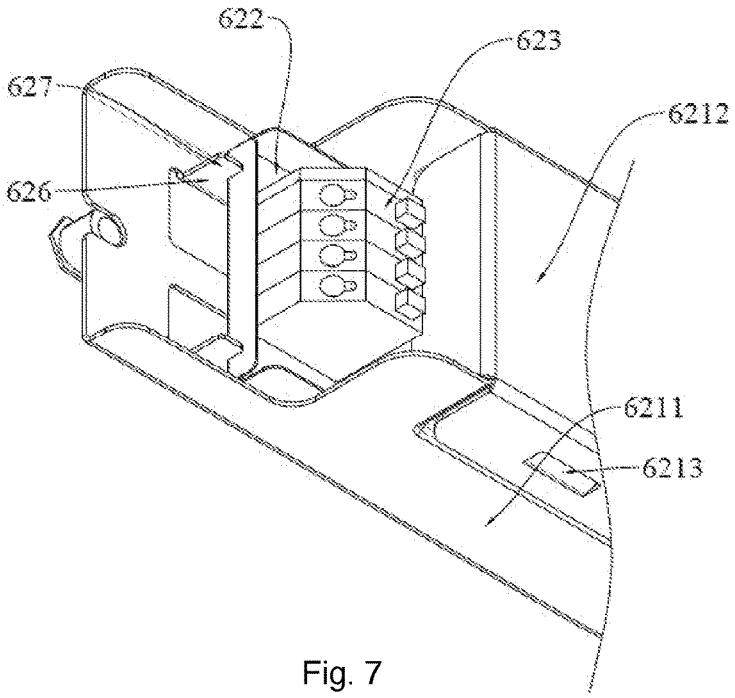
FIG. 7 illustrates a zoom-up view of a wire terminal.
Figure 8:
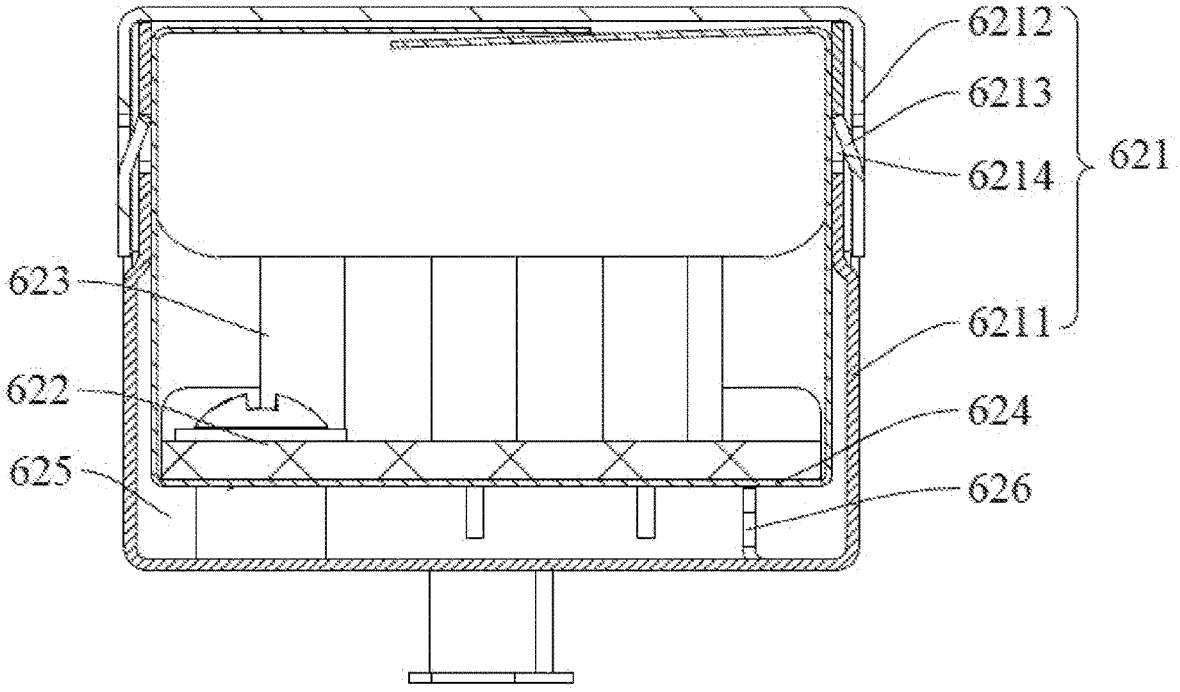
FIG. 8 illustrates a driver cover structure.
Figure 9:
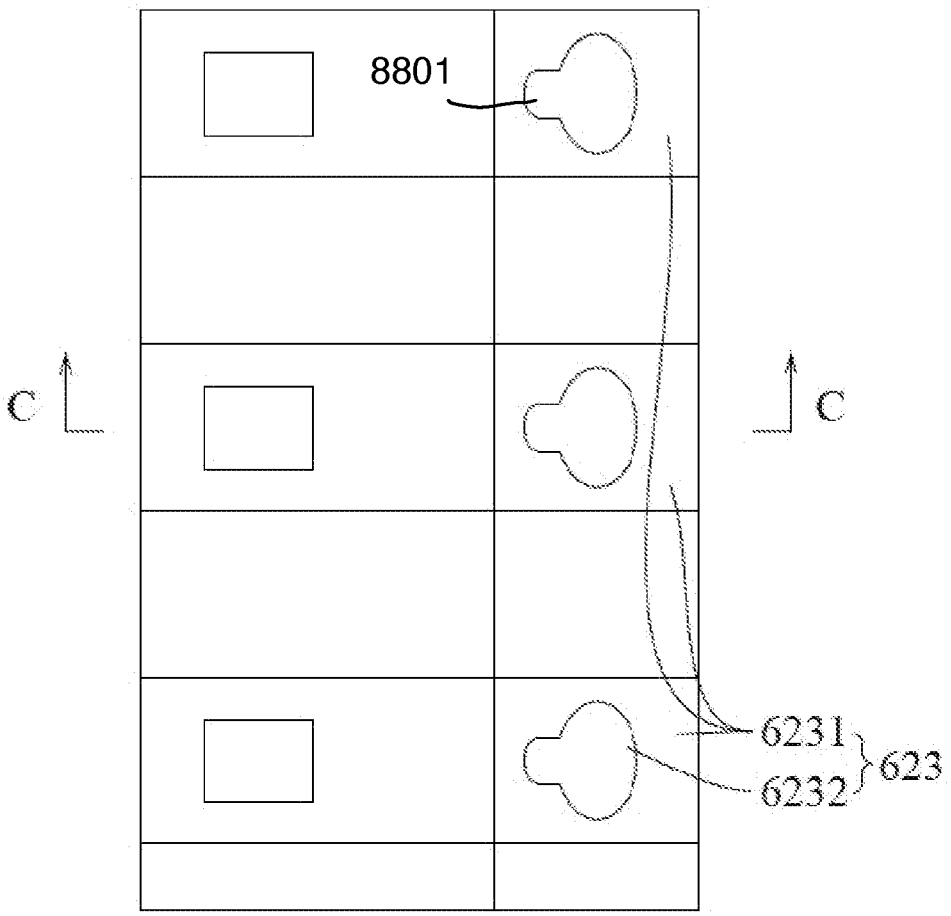
FIG. 9 illustrates a top view of a wire terminal component.

Please refer to FIG. 7 and FIG. 8. The housing 621 includes a bottom housing 6211 below the circuit board 622 and a detachably connecting top housing 6212 connected to the bottom housing 6211. The top housing 6212 and the bottom housing 6211 together form the container cavity for storing the driver module.

The detachable connection between the top housing 6212 and the bottom housing 6211 is convenient for assembly and decreases manufacturing cost.

Specifically, the bottom housing 6211 has a longer length than the length of the circuit board 622. The wire terminal 623 is located outside the container cavity defined by the top housing 6212 and the bottom housing 6211. The second plugging hole 6232, as the receiver socket, is facing outwardly.

Specifically, there is a buckle 6213 on the top housing 6212. There is a container groove 6214 disposed on the bottom housing 6211 corresponding to the buckle 6213.

The bottom of the buckle 6213 is connected to the top housing 6212. The top side is an active end. When the top housing 6212 and the bottom housing 6211 are buckled, the active end of the buckle 6213 is shrunk toward lateral wall direction of the top housing 6212 to enters the container groove 6214 to complete the buckling connection.

There is a hand-held portion disposed on the external wall of the buckle 6213. The hand-held portion is extended outside the top housing 6212. When the top housing 6212 needs to be detached from the bottom housing 6211, the hand-held portion may be pulled outwardly for escaping the buckle 6213 from the container groove 6214. Then, the top housing 6212 is pulled upwardly to detach from the bottom housing 6211.

Please refer to FIG. 8. The driver module 620 also includes a support plate 624. The support plate 624 is disposed in the container cavity. The circuit board 622 is disposed on the support plate 624. The support plate 624 has a bottom surface in parallel with a surface of the bottom housing 6211 forming a heat dissipation channel 625.

The support plate 624 provides a heat dissipation channel 625 so that heat of the driver circuit of the driver module is carried away by air flowing in the heat dissipation channel 625.

Figure 6:
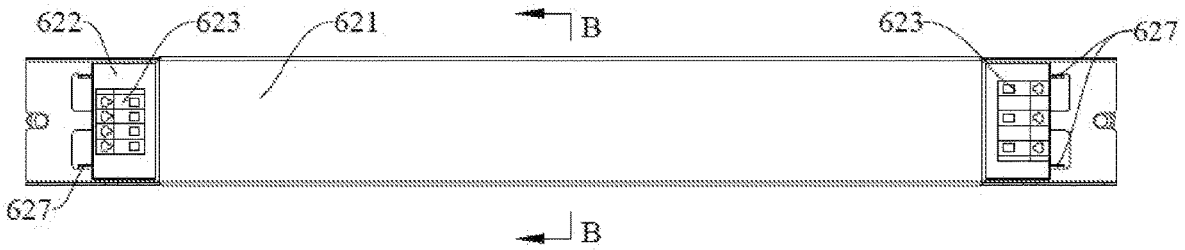
FIG. 6 illustrates a driver module with wire terminals.

Please refer to FIG. 6 to FIG. 8. Two ends of the bottom housing 6211 have support pieces 626 for supporting the support plate 624.

There is a stop block 627 on an external wall of the support piece 626. The two stop blocks 627 respectively disposed on two ends of the bottom housing 6211 are used for clipping the support plate 624.

In FIG. 8, the circuit board 622, the support plate 624 and the bottom plate of the bottom housing 6211 may be detachably connected with a screw bolt.

The screw bolt increases a connection stability of the circuit board 622, the support plate 624 and the bottom housing 6211.

The foregoing description, for purpose of explanation, has been described with reference to specific embodiments. However, the illustrative discussions above are not intended to be exhaustive or to limit the invention to the precise forms disclosed. Many modifications and variations are possible in view of the above teachings.

The embodiments were chosen and described in order to best explain the principles of the techniques and their practical applications. Others skilled in the art are thereby enabled to best utilize the techniques and various embodiments with various modifications as are suited to the particular use contemplated.

Although the disclosure and examples have been fully described with reference to the accompanying drawings, it is to be noted that various changes and modifications will become apparent to those skilled in the art. Such changes and modifications are to be understood as being included within the scope of the disclosure and examples as defined by the claims.

The invention claimed is:

1. A panel light apparatus comprising:

a back plate having four lateral walls and a bottom plate, a back side of the bottom plate comprising multiple sets of folding hooks, each set corresponding a different installation platform, one of the multiple sets of folding hooks being folded to be used for hooking to a corresponding installation platform;

a light source module having multiple LED modules disposed on the bottom plate, each LED module having a LED device and a lens, the lens diffusing a light of the LED device to be evenly emitted from the lens and broadening an output angle of the light via the lens;

a diffusion plate with a peripheral edge fixed to the four lateral walls of the back plate;

a driver module; and a driver cover attached to an external side of one of the four walls of the back plate, the driver cover defining a container cavity for concealing the driver module, wherein the driver cover has multiple sections, a first section of the multiple sections is used for containing the driver module, a second section of the multiple sections is used for connecting a first wire, there is a separator between the first section and the second section.

2. The panel light apparatus of claim 1, wherein the driver module comprises a wire terminal, a driver circuit board, a driver wire, the wire terminal has a tilt receiver side with a tilt angle with respect to the driver circuit board, the wire terminal comprises an insulation body, a receiver socket and an electrode, the receiver socket has a tilt angle between 10 degrees to 80 degrees with respect to a driver circuit board of the driver module, the receiver socket is connected to a wire plug for electrically transmitting an external power to the driver circuit board via the electrode and the driver wire, the receiver socket further has a limiter for increasing friction between the receiver socket and the wire plug.

3. The panel light apparatus of claim 2, wherein the limiter is a hole with a smaller diameter than a main hole for receiving a main part of the wire plug.

4. The panel light apparatus of claim 1, wherein the driver cover is made of metal material.

5. The panel light apparatus of claim 1, wherein the driver cover and an exterior surface of one lateral wall of the back plate together form the container cavity for concealing the driver module.

6. The panel light apparatus of claim 1, wherein the multiple LED modules are divided and placed on multiple LED strips disposed in parallel, and wherein a conductive path is placed away from peripheral edge of the bottom plate with a distance from the peripheral edge of more than 10% of a width of the bottom plate, the conductive path is used for electrically connecting the multiple LED strips to the driver module.

7. The panel light apparatus of claim 1, wherein a third section of the multiple sections is used for connecting a second wire, a voltage passing the first wire is larger than a voltage passing the second wire.

8. The panel light apparatus of claim 1, wherein the multiple sets of folding hooks are fit to a surface of the back plate.

9. The panel light apparatus of claim 1, wherein one of the multiple sets of folding hooks are located at four corners of the back plate.

10. The panel light apparatus of claim 1, wherein a connection edge between the four lateral walls and the bottom plate has a curved reflective area for reflecting the light of the LED modules toward the diffusion plate.

11. The panel light apparatus of claim 1, wherein the bottom plate has a metal layer and reflective layer, the reflective layer of the bottom plate help reflecting a light of the multiple LED modules emitting on the reflective layer of the bottom plate.

12. A panel light apparatus comprising:

a back plate having four lateral walls and a bottom plate, a back side of the bottom plate comprising multiple sets of folding hooks, each set corresponding a different installation platform, one of the multiple sets of folding hooks being folded to be used for hooking to a corresponding installation platform;

a light source module having multiple LED modules disposed on the bottom plate, each LED module having a LED device and a lens, the lens diffusing a light of the LED device to be evenly emitted from the lens and broadening an output angle of the light via the lens;

a diffusion plate with a peripheral edge fixed to the four lateral walls of the back plate;

a driver module; and a driver cover attached to an external side of one of the four walls of the back plate, the driver cover defining a container cavity for concealing the driver module, wherein the bottom plate has multiple curved reflective areas respectively facing toward the multiple LED modules for reflecting the light of the multiple LED modules toward the diffusion plate.

13. A panel light apparatus comprising:

a back plate having four lateral walls and a bottom plate, a back side of the bottom plate comprising multiple sets of folding hooks, each set corresponding a different installation platform, one of the multiple sets of folding hooks being folded to be used for hooking to a corresponding installation platform;

a light source module having multiple LED modules disposed on the bottom plate, each LED module having a LED device and a lens, the lens diffusing a light of the LED device to be evenly emitted from the lens and broadening an output angle of the light via the lens;

a diffusion plate with a peripheral edge fixed to the four lateral walls of the back plate;

a driver module; and a driver cover attached to an external side of one of the four walls of the back plate, the driver cover defining a container cavity for concealing the driver module, wherein the LED module has multiple LED devices integrated on a package, the multiple LED devices on the package are positioned to have different angles for emitting multiple lights from the package.

14. The panel light apparatus of claim 13, wherein the multiple lights of the multiple LED devices for different angles have different light intensities.

15. The panel light apparatus of claim 13, wherein the light intensities are adjusted by the driver module to provide an overall even output on the diffusion layer.

16. The panel light apparatus of claim 15, wherein an external device captures an output light pattern appeared on the diffusion plate and sends a message related to the captured output light pattern to the driver module to adjust the intensities of the multiple LED devices in the package.

17. The panel light apparatus of claim 1, wherein the driver module has a first driver part and a second driver part, when one of the first driver part and the second driver part is damaged, the other of the first driver part and the second driver part is activated.

18. The panel light apparatus of claim 1, wherein the LED modules are divided into groups to be controlled by the driver module separately to produce different light areas as requested by a user.

19. The panel light apparatus of claim 18, wherein the groups correspond to luminance areas of different dimensions.

* * * * *